United States Patent [19]

Leifeld

[11] 4,275,482

[45] Jun. 30, 1981

[54] ARRANGEMENT FOR FORMING A SLIVER FROM A CARD WEB

[75] Inventor: Ferdinard Leifeld, Kempen, Fed. Rep. of Germany

[73] Assignee: Trutzschler GmbH & Co. KG, Monchen-Gladbach, Fed. Rep. of Germany

[21] Appl. No.: 73,525

[22] Filed: Sep. 7, 1979

[30] Foreign Application Priority Data

Sep. 11, 1978 [DE] Fed. Rep. of Germany ..... 2839414

[51] Int. Cl.[3] ..... D01G 15/46

[52] U.S. Cl. ..... 19/150; 19/106 R

[58] Field of Search ..... 19/106 R, 150

[56] References Cited

U.S. PATENT DOCUMENTS

| | | | |
|---|---|---|---|
| 2,897,549 | 8/1959 | Paterson | 19/106 R |
| 3,296,663 | 1/1967 | Reiterer | 19/106 R |
| 3,319,302 | 5/1967 | Schmauder | 19/106 R |
| 3,825,975 | 7/1974 | Staeheli | 19/106 R |
| 3,925,850 | 12/1975 | Lytton | 19/150 |

*Primary Examiner*—Louis Rimrodt

*Attorney, Agent, or Firm*—Haseltine and Lake

[57] ABSTRACT

An arrangement for carding fibers to produce a fibrous sliver, in which the fibrous sliver is advanced through the nip between two rollers, and withdrawn downwardly from the nip through a compacting funnel in which the sliver becomes formed with a coherent ribbon. The fibrous sliver is withdrawn in a vertical path coinciding with a center line of the nip, or it may be withdrawn in a path which is inclined to the longitudinal end to a center line of the nip. The pair of nip rollers are positioned to receive the fibrous sliver so that the latter passes through the nip therebetween. The spacing between the nip rollers and a guide baffle is arranged to be greater than the spacing between the guide baffle and a pair of withdrawing rollers located downstream of the funnel.

7 Claims, 11 Drawing Figures

ARRANGEMENT FOR FORMING A SLIVER FROM A CARD WEB

BACKGROUND OF THE INVENTION

The present invention relates to the carding of fibers. More particularly, the invention relates to a method and an arrangement for carding fibers to convert them into a fibrous sliver, and for compacting the sliver into a coherent ribbon.

In conventional carding arrangements the fibers are carded, i.e. opened up, converted into a fibrous sliver by passing through the nip between a pair of slip rollers, and then traverse a generally horizontal path before they enter into a compacting funnel wherein the sliver is compacted to form a ribbon as it passes through the funnel to be withdrawn from the outlet end of the funnel by a pair of wood drawing rollers. As the fibrous sliver passes from the nip rollers to the funnel, its cross-sectional configuration is approximately triangular and it is known that the fibers along the outer edges of this triangle are particularly susceptible to tearing. It has been observed that particularly at high production speed, e.g. more than 50 kg/h, the coherents of the fibrous sliver is not adquate because the passage of the fibrous sliver at high speed through the ambiant air causes a sufficient air stream to flow towards the edges of the fibrous sliver, to separate fiber along the edges and begin a disintegration of the fibrous sliver which may lead to tearing.

SUMMARY OF THE INVENTION

It is, accordingly, an object of the present invention to avoid the disadvantages of the prior art.

More particularly, it is an object of the present invention to provide an improved method, and an arrangement for carrying out the method, which avoids tearing of the fibrous sliver, particularly in the region of the edges of the same and especially in high speed operation.

In keeping with the above objects, and with others which will become apparent hereafter, one feature of the invention resides, in a carding method, in the steps of carding the fibers to produce a fibrous sliver, advancing the fibrous sliver through the nip between two rollers, and thereupon withdrawing the fibrous sliver downwardly from the nip through a compacting funnel wherein the sliver becomes formed into a coherent ribbon.

An arrangement for carrying out the method may comprise means for carding fibers to produce a fibrous sliver, a pair of nip rollers positioned to receive the fibrous sliver so that the same passes through the nip between the rollers, and means, including a sliver-compacting funnel, arranged beneath the nip rollers for withdrawing the fibrous sliver from the nip thereof and converting it into a coherent ribbon.

The basic concept of the present invention is based on the realization that if fibrous sliver passes in a generally horizontal path from the nip rollers to the compacting funnel, a component of movement develops which differs from the direction of advancement of the fibrous sliver, i.e. the sliver tends to sag and this may lead to its tearing. The problem is avoided by having the sliver pass from the nip of the nip rollers either directly vertically or at least only at an angle to the horizontal, into the sliver-compacting funnel so that the deviant component of movement observed in the prior art is omitted and the tearing tendency thereby avoided.

It is advantageous, but not absolutely necessary, that the nip rollers not be located one above the other, i.e. that their axis of rotation are not located in a common vertical plane.

It is also advantageous if the funnel together with the withdrawing rollers thereof is arranged spaced from the nip rollers in the direction of movement of the fibrous sliver, i.e. coincident with an imaginary line passing through the center of the nip between the nip rollers. Preferably, the funnel and the withdrawing rollers will be arranged beneath the nip rollers but laterally offset so that the path of movement of the fibrous sliver from the nip rollers to the funnel and the withdrawing rollers is inclined to the horizontal. However, it is also possible to have the nip rollers arranged horizontally, i.e. with their axis of rotation located in a common horizontal plane, and to have the funnel with the withdrawing rollers located directly vertically beneath them.

A guide baffle may be provided, having a non-movable guide surface and being located intermediate the funnel and the nip rollers. The spacing between the nip rollers and the guide baffle may be larger than the spacing between the guide baffle and the funnel. The purpose of the guide baffle is, of course, to improve operational reliability by preventing lateral breaking-away of the fibrous sliver.

In a simple embodiment the guide baffle may merely be a planar plate having an opening though which the fibrous sliver passes to the funnel. However, the guide baffle may also be arched or may be inclined. The opening itself may be a hole in the guide baffle or it may be a slot defined between two guide surfaces of the baffle. It is preferred, currently, that the guide surface of the guide baffle has a horizontal orientation and is arranged vertically beneath the nip roller. It is also possible to provide means, known per se in the art, for varying the distance between the guide baffle and nip rollers so that the guide baffle can be moved either closer to the nip rollers or closer to the funnel. The guide baffle, together with the funnel and the withdrawing rollers, may be shiftable towards and away from the nip rollers, again by means known per se from the art and therefore requiring no detailed description. Sometimes residual contaminants will adhere to the fibers, and these being of a particular nature the guide baffle may be perforated so that such contaminants may drop through the perforations of the baffle and move out of the way.

The invention is defined in the appended claims. To promote its understanding, however, it will now be described with reference to the appended drawing.

DESCRIPTION OF PREFERRED EMBODIMENTS

Figure 1:
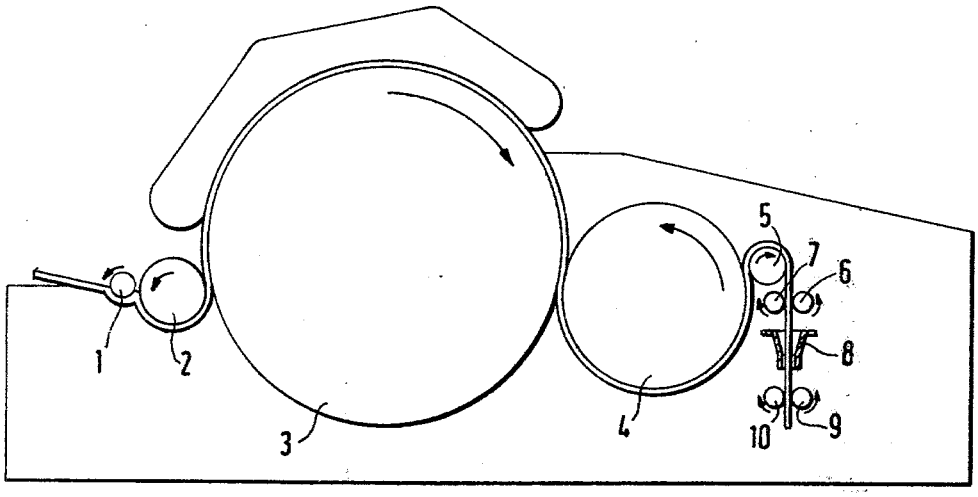
FIG. 1 is a somewhat diagrammatic side view of a carding arrangement according to one embodiment of the invention.

FIG. 1 is a diagrammatic side view of a carding arrangement for carrying out the present invention. A more detailed illustration and description of the arrangement is not believed to be necessary because, except for the inventive feature which will be more fully described, the carding arrangement is conventional.

The arrangement includes a feed-in roller 1 at which fibers to be carded are fed into the arrangement. On entering the arrangement the fibers are opened up by an opening roller 2 and then pass on to a carding roller or drum where they are carted and delivered to a take-off roller 4 from which they are, in turn, removed by a scraper roller 5 as a fibrous sliver.

A pair of nip rollers 6, 7 is provided which, unlike the prior art, are arranged in a common horizontal plane, i.e. their axis of rotation are located in a common horizontal plane. The fibrous sliver passes from the scraper roller 5 into the nip between the rollers 6, 7 and from there into a compacting funnel 8 which is known per se from the art and which, according to the invention, is located directly vertically below the nip of the rollers 6, 7. Also located directly vertically below the outlet end of the funnel 8 is a pair of withdrawing rollers 9, 10 into which the fibrous ribbon, to which the fibrous sliver has been compacted in the funnel 8, enters so as to be withdrawn and advanced to some further populating stage which is of no importance in the context of the present invention.

Figure 2:
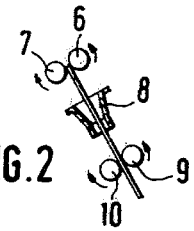
FIG. 2 is a fragmentary detailed view of another inclined embodiment showing roller of the compacting funnel and take-off rollers.

The embodiment in FIG. 2, shows that instead of being located directly beneath the scraper roller 5 as in FIG. 1, with the nip directed vertically, the nip rollers 6, 7 may be inclined so that a center line passing through their nip includes an angle with the horizontal. In this embodiment the funnel 8 and the withdrawing rollers 9, 10 are similarly laterally offset so that the fibrous sliver is withdrawn in a path which is not coincident with the nip between the rollers and 6, 7 but which is inclined to the horizontal rather than being vertical as in FIG. 1.

Figure 3:
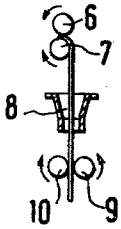
FIG. 3 is a view analogous to FIG. 2, but illustrating an additional embodiment of the invention.

In the embodiment of FIG. 3, the nip rollers 6, 7 are arranged with their axes of rotation located in a common vertical plane, i.e. in the manner customary in the prior art. Unlike the prior art, however, the compacting funnel 8 is located directly vertically below the nip rollers 6, 7, in such a manner that the vertical center line of the funnel 8 forms a tangent to the rollers 6, 7. The withdrawal rollers 9, 10 are again located beneath the outlet end of the funnel 8.

Figure 4:
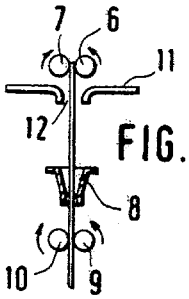
FIG. 4 is another view similar to FIG. 2, illustrating a further embodiment of the invention.

In the embodiment of FIG. 4, which generally corresponds to the one in FIG. 1, an additional element is provided, namely a guide baffle 11 which is located immediately downstream of the nip rollers 6, 7, and has a central opening 12 for which the fibrous sliver passes on its way to the funnel 8. In this embodiment the guide baffle 11, which is stationarily mounted in any known per se manner, is in form of a planar or plate whose opening 12 is centered on the inlet of the funnel 8.

Figure 5:
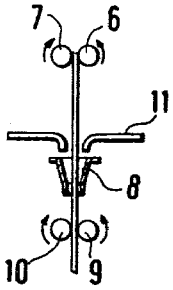
FIG. 5 is a view reminiscent of the one in FIG. 4, illustrating yet a further embodiment of the invention.

The embodiment in FIG. 5, is essentially the same as in FIG. 4, except that here the guide baffle 11 is located closer to the funnel 8 then to the nip rollers 6, 7. In all other respects the embodiment of FIG. 5 is identical with that in FIG. 4. Again, the guide baffle 11 is stationarily mounted.

Figure 6:
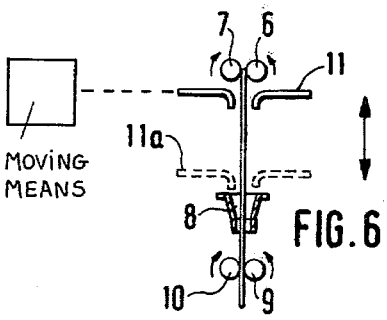
FIG. 6 illustrates an embodiment analogous to the one in FIG. 5, but provided with means for moving the guide baffle.

FIG. 6, also corresponds essentially to the embodiments in FIGS. 4 and 5, the difference being that the guide baffle 11 is not stationary. Instead, it can be raised and lowered as indicated by the double-headed arrows so that it can be moved closer to the nip rollers 6, 7 as shown in solid lines, or closer to the funnel 8 as indicated in broken lines and with the reference numeral 11*h*. Means for moving the guide baffle 11 in this manner are diagrammatically illustrated, being known per se from the prior art, as are arrangements for mounting the guide baffle 11 so that it can move in the indicated manner.

Figure 7:
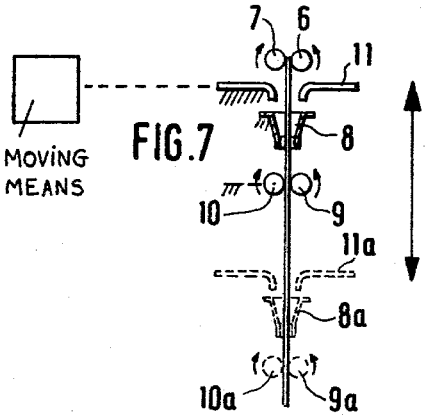
FIG. 7 is a view similar to FIG. 6, but provided with means for moving the guide baffle, the funnel and with the withdrawing rollers.

FIG. 7 differs from the embodiment in FIG. 6 in that it is not merely the guide baffle 11 which can be moved as indicated by the double dash headed arrow to and from the position 11*a*, but the funnel 8 and the withdrawal rollers 9, 10 are similarly mounted for movement, all being connected to the diagrammatically illustrated known per se moving means. Thus, the rollers 9, 10 can assume the positions 9*a*, 10*a* shown in broken lines, the funnel 8 can assume the broken dash line position 8*a* and the guide baffle can assume the broken dash line position 11*a*, it being understood that in FIGS. 6 and 7, the movement of the movable elements is affected and dependent upon operating conditions which may make it necessary or advisable to have the movable elements either closer to or farther away from the nip rollers 6, 7.

Figure 8:
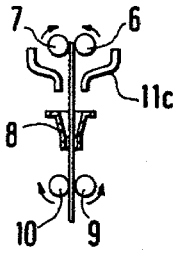
FIG. 8 illustrates an embodiment similar to the one in FIG. 5, but with a curved guide baffle.

The embodiment in FIG. 8 corresponds to the one illustrated in FIG. 4, except that here the guide baffle 11*c* is not in form of a planar plate, but instead is in form of a hopper dash shaped element having curved guide surfaces which define the entry path for the fibrous sliver into the funnel 8.

Figure 9:
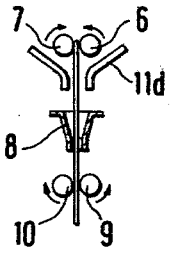
FIG. 9 is a view of an embodiment similar to FIG. 8, but having a conically inclined guide baffle.

FIG. 9 also is similar to the one embodiment in FIG. 8, except that the guide baffle 11*d* has conically inclined guide surfaces.

Figure 10:
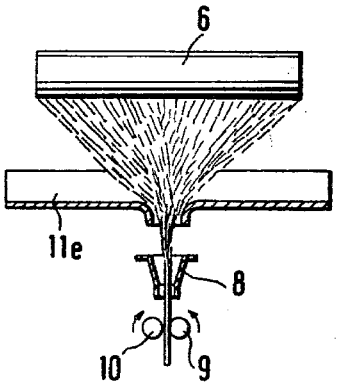
FIG. 10 is a side view of a further embodiment having a one-part guide baffle.

In the embodiment of FIG. 10, like reference numerals again identify like element as before, the embodiment being the same as the one in e.g. FIG. 4, except that the guide baffle 11*e* is of one piece and its lateral edges are bent up as indicated by its sectioned showing. The nip roller 7 is here not visible because it is concealed behind the nip roller 6 which is illustrated.

Figure 11:
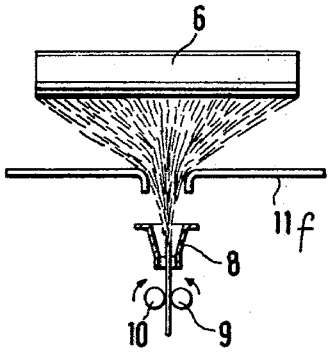
FIG. 11 is a view similar to FIG. 10, but showing a two-part guide baffle.

The embodiment of FIG. 11, is similar to the one in FIG. 10 except that the guide baffle is here designated with reference numeral 11*f* and is composed of two parts adjacent edges of which are bent downwardly to define a slot-shaped opening between which the fibrous sliver travels to the funnel 8.

Although in FIGS. 8–11 the guide baffles are shown to be stationarily mounted, it should be understood that the guide baffles shown in these figures could also be movably mounted as shown in FIGS. 6 and 7.

The invention has hereinbefore been described and illustrated with reference to several exemplary embodiments. It is to be understood, however, that this is for information only and that various modifications may be made without departing from the intended scope of the invention. The protection sought for the invention is to be considered defined exclusively in the appended claims.

What is claimed is:

1. In a carding arrangement, a combination comprising means for carding fibers to produce a fibrous sliver; a pair of nip rollers positioned to receive the fibrous sliver so that the same passes through the nip between said rollers; means, including a sliver-compacting funnel, arranged beneath said nip rollers for withdrawing the fibrous sliver from the nip thereof and converting it with a coherent ribbon; and a sliver guide baffle surrounding the path of movement of said sliver intermediate said nip rollers and said withdrawing means.

2. A combination as defined in claim 1, wherein the spacing between said nip rollers and said guide baffle is greater than the spacing between said guide baffle and a pair of withdrawing rollers located downstream of said funnel.

3. A combination as defined in claim 1, said guide baffle having a longitudinally oriented guide surface.

4. A combination as defined in claim 1, said guide baffle having a guide surface which is located vertically beneath said nip rollers.

5. A combination as defined in claim 1, and further comprising means for moving said guide baffle towards and away from said nip rollers and compacting funnel, respectively.

6. A combination as defined in claim 1; said withdrawing means further comprising a pair of withdrawing rollers downstream of said compacting funnel; and further comprising means for moving said guide baffle, compacting funnel and withdrawing rollers towards and away from said nip rollers.

7. A combination as defined in claim 1, wherein the spacing between said nip rollers and said guide baffle is greater than the spacing between said guide baffle and a pair of withdrawing rollers located downstream of said funnel; said guide baffle having a longitudinally oriented guide surface; said guide baffle having a guide surface located vertically beneath said nip rollers; said withdrawing means further comprising a pair of withdrawing rollers downstream of said compacting funnel; and means for moving said guide baffle, compacting funnel and withdrawing rollers towards and away from said nip rollers.

* * * * *